US007553194B2

(12) United States Patent
Wang et al.

(10) Patent No.: US 7,553,194 B2
(45) Date of Patent: Jun. 30, 2009

(54) ELECTRICAL CONNECTOR

(75) Inventors: Ning Wang, Kunshan (CN); Zhi-Qiang Chen, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/077,564

(22) Filed: Mar. 20, 2008

(65) Prior Publication Data

US 2008/0233805 A1 Sep. 25, 2008

(30) Foreign Application Priority Data

Mar. 20, 2007 (CN) ..... 2007 2 0035603 U

(51) Int. Cl.
*H01R 24/04* (2006.01)

(52) U.S. Cl. ..... 439/668; 439/118; 439/944

(58) Field of Classification Search ..... 439/668–669, 439/188, 944
See application file for complete search history.

(56) References Cited

U.S. PATENT DOCUMENTS

| | | | | |
|---|---|---|---|---|
| 5,547,400 | A * | 8/1996 | Wright | 439/668 |
| 6,676,451 | B2 * | 1/2004 | Suzuki et al. | 439/668 |
| 6,908,343 | B1 * | 6/2005 | Hu | 439/668 |
| 7,094,088 | B2 | 8/2006 | Wang et al. | |
| 2002/0052149 | A1 * | 5/2002 | Suzuki et al. | 439/668 |
| 2006/0234562 | A1 * | 10/2006 | Lin | 439/668 |

* cited by examiner

*Primary Examiner*—Truc T Nguyen
(74) *Attorney, Agent, or Firm*—Wei Te Chung

(57) ABSTRACT

An electrical connector includes an insulative housing (1) defining a receiving cavity (121) therein, at least one terminal (2) arranged in the housing, a sleeve (4) retained in an inside of the receiving cavity and a grounding contact (5) defining a clip portion (52) to lock the sleeve in the housing.

15 Claims, 7 Drawing Sheets

ELECTRICAL CONNECTOR

BACKGROUND OF THE INVENTION

1. Field of the Invention

The present invention relates to an electrical connector, and more particularly to an electrical connector with an inner sleeve therein.

2. Description of the Prior Art

A conventional audio jack or power connector generally includes an insulative housing defining a mating portion with a plug insertion columnar hole thereof and a sleeve assembled inside the columnar hole so as to completes an electrical connection between the connector and a counter connector. In common use, the counter connector is used to be inserted into the mating portion to establish an electrical engagement and pulled out to cutoff the engagement. However, during the iterative operate process, the inner sleeve may break off the mating portion thereby resulting in a disconnection of the electrical connector with the counter connector. Therefore, a new design to solve the problem is required.

SUMMARY OF THE INVENTION

An object of the present invention is to provide an electrical connector with a grounding contact to prevent an inner sleeve from breaking off the electrical connector.

In order to achieve above-mentioned objects, an electrical connector includes an insulative housing defining a receiving cavity therein, at least one terminal arranged in the housing, a sleeve retained in an inside of the receiving cavity and a grounding contact defining a clip portion to lock the sleeve in the insulative housing.

Other objects, advantages and novel features of the invention will become more apparent from the following detailed description of the present embodiment when taken in conjunction with the accompanying drawings.

DETAILED DESCRIPTION OF THE INVENTION

Figure 1:
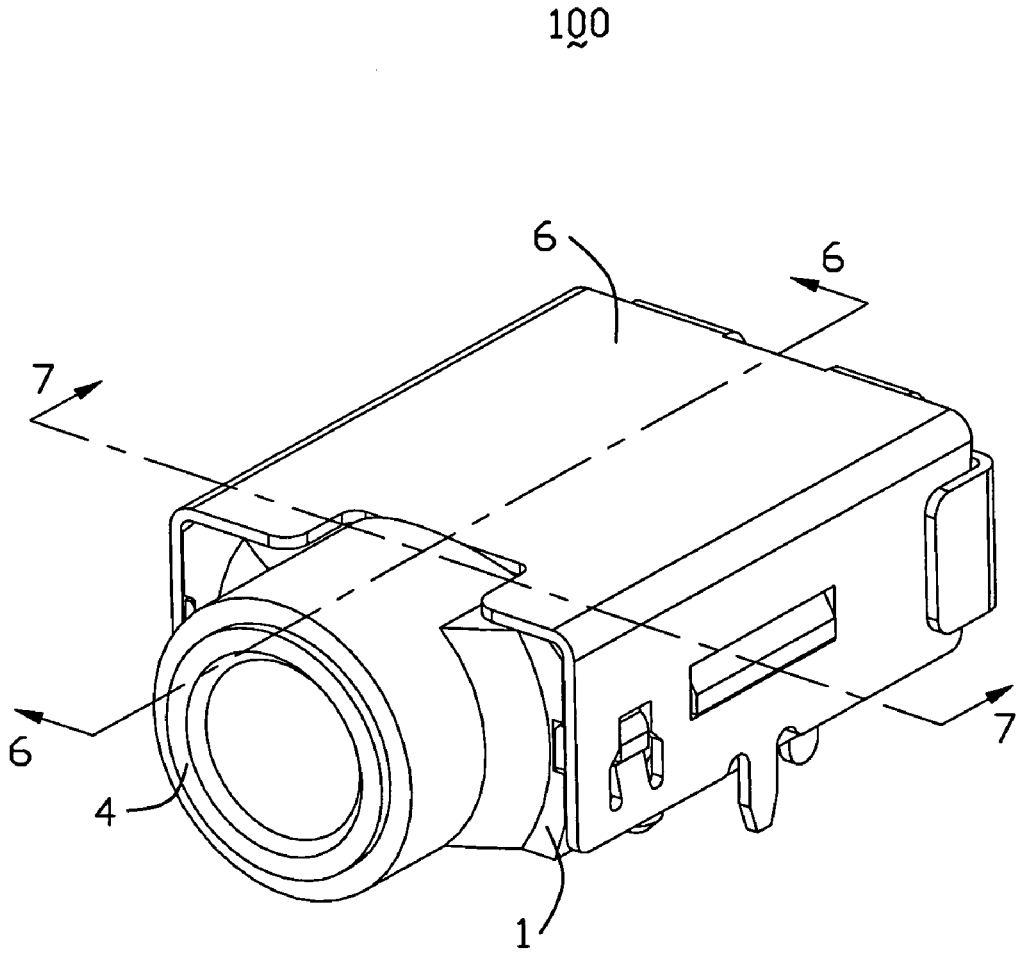
FIG. 1 is a perspective view of an electrical connector in accordance with the present invention.

Reference will now be made to the drawing figures to describe the preferred embodiment of the present invention in detail.

Referring to FIG. 1, an electrical connector 100 according with the present invention comprises an insulative housing 1, a plurality of terminals in the housing and a shielding shell 6 surrounding an outer surface of the housing 1.

Figure 2:
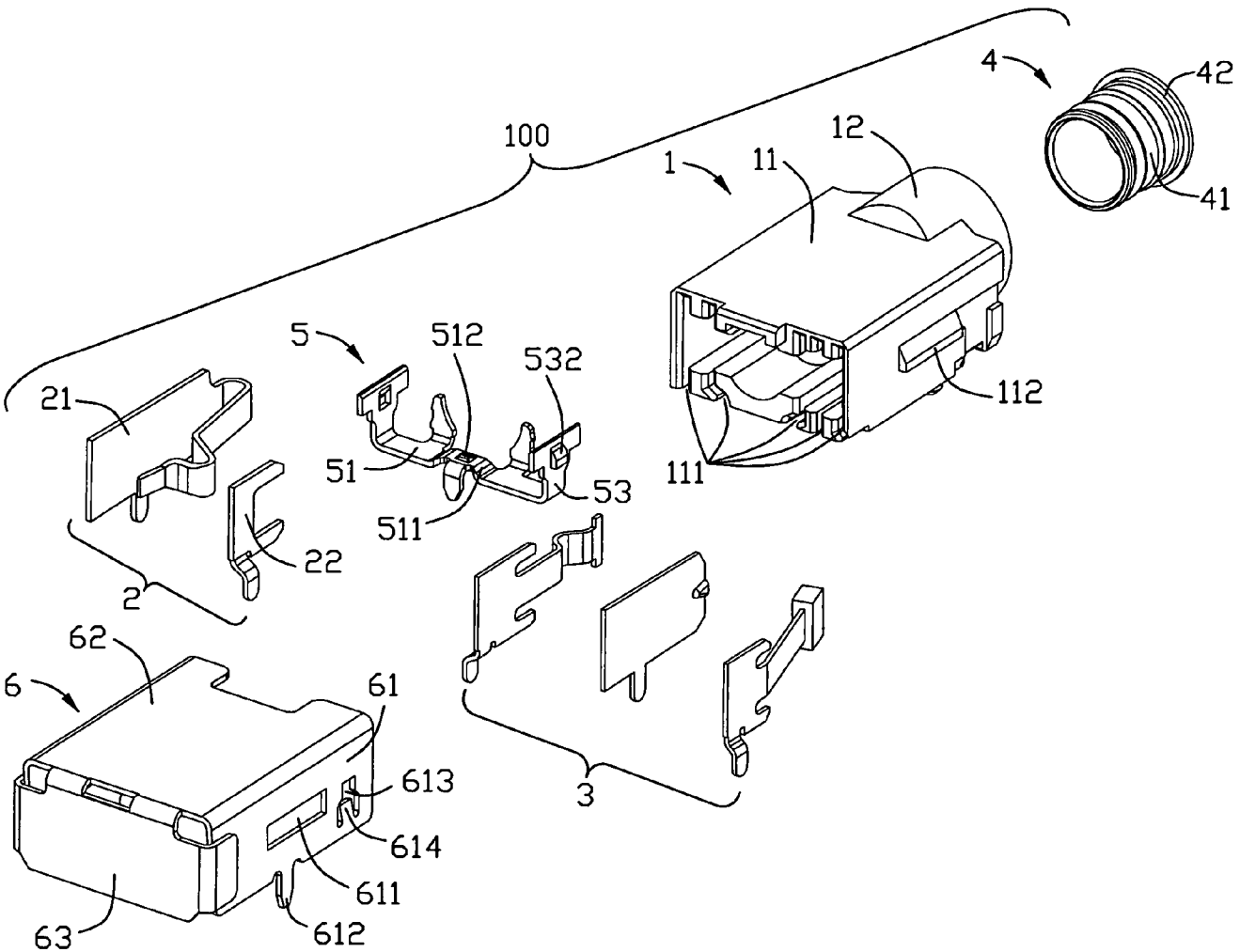
FIG. 2 is an exploded perspective view of the electrical connector of FIG. 1.
Figure 3:
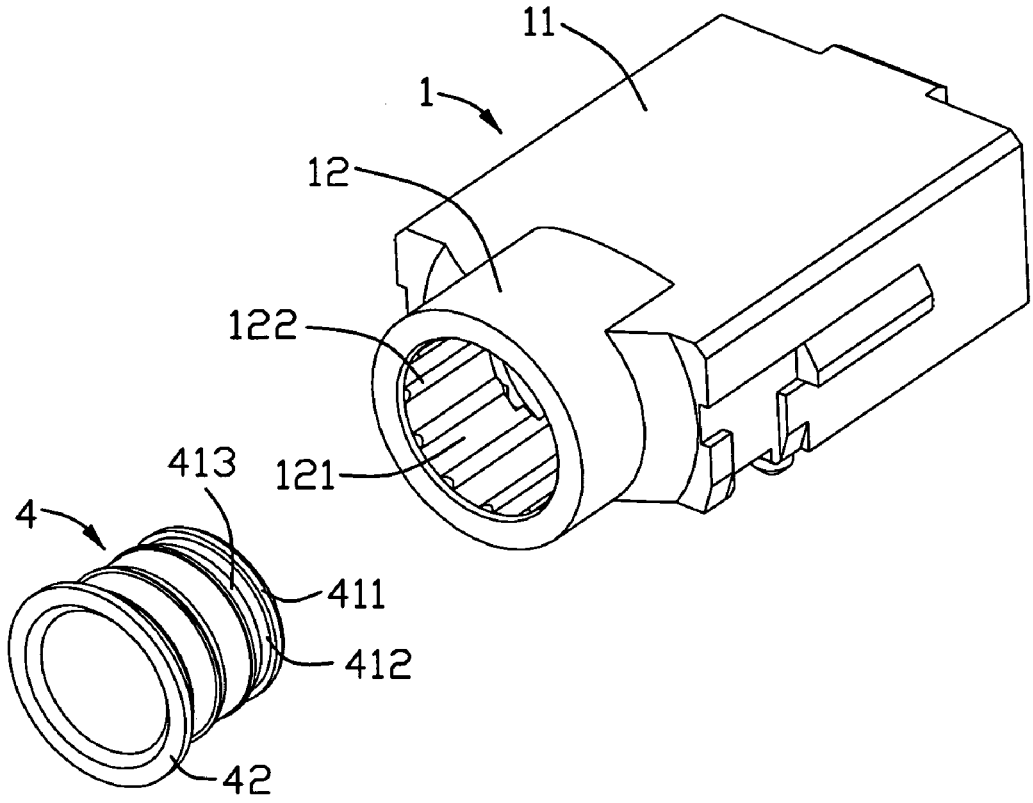
FIG. 3 is an exploded perspective view of the housing and the sleeve.

Referring to FIGS. 2 and 3, the insulative housing 1 comprises a main body 11 in shape of a rectangular block and a cylindrical mating portion 12 extending from a front side of the main body 11. A receiving cavity 121 is defined through the front side of the mating portion 12 and the back of the main body 11 along a front-to-back direction to allow an insertion of a plug (not shown). A plurality of terminal grooves 111 is defined at the rear wall of the housing and extends forwardly along a back-to-front direction at two sides of the receiving cavity 121. The terminals 2 are inserted into the terminal grooves 111 from the rear of the housing 1.

In this embodiment, the connector sets two groups of terminals, a first terminal group 2 comprising a moveable terminal 21 and a fixing terminal 22, and a second terminal group 3 comprising three terminals cooperating with each other. The assemble process and work theory of the terminals is conventional, which can be referred to U.S. Pat. No. 7,094,088.

Referring to FIGS. 2 and 3, a sleeve 4 made from metal material is provided and comprises a base portion 41 received in the receiving cavity 121. An annular groove 412 is provided between two annular protrusions 411, 413 along an outer perimeter surface at one end of the sleeve 4. An annular blocking portion 42 is formed at the front distal end opposite to said one end of the sleeve. The sleeve 4 is inserted into the mating portion 12 along the front-to-back direction, with the blocking portion 42 being blocked by the front surface of the mating portion 12.

Figure 4:
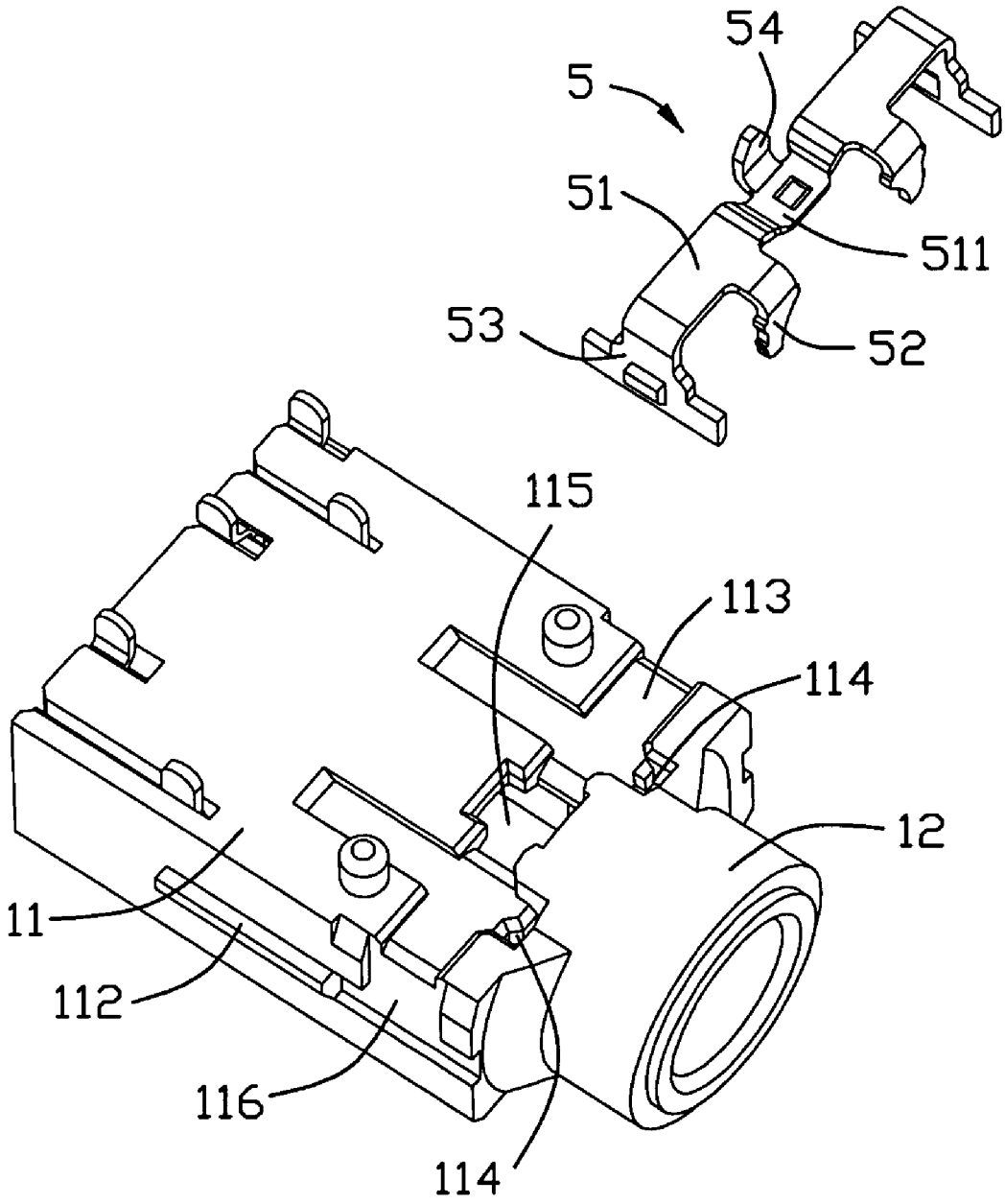
FIG. 4 is an exploded perspective view of the housing and the grounding contact.
Figure 6:
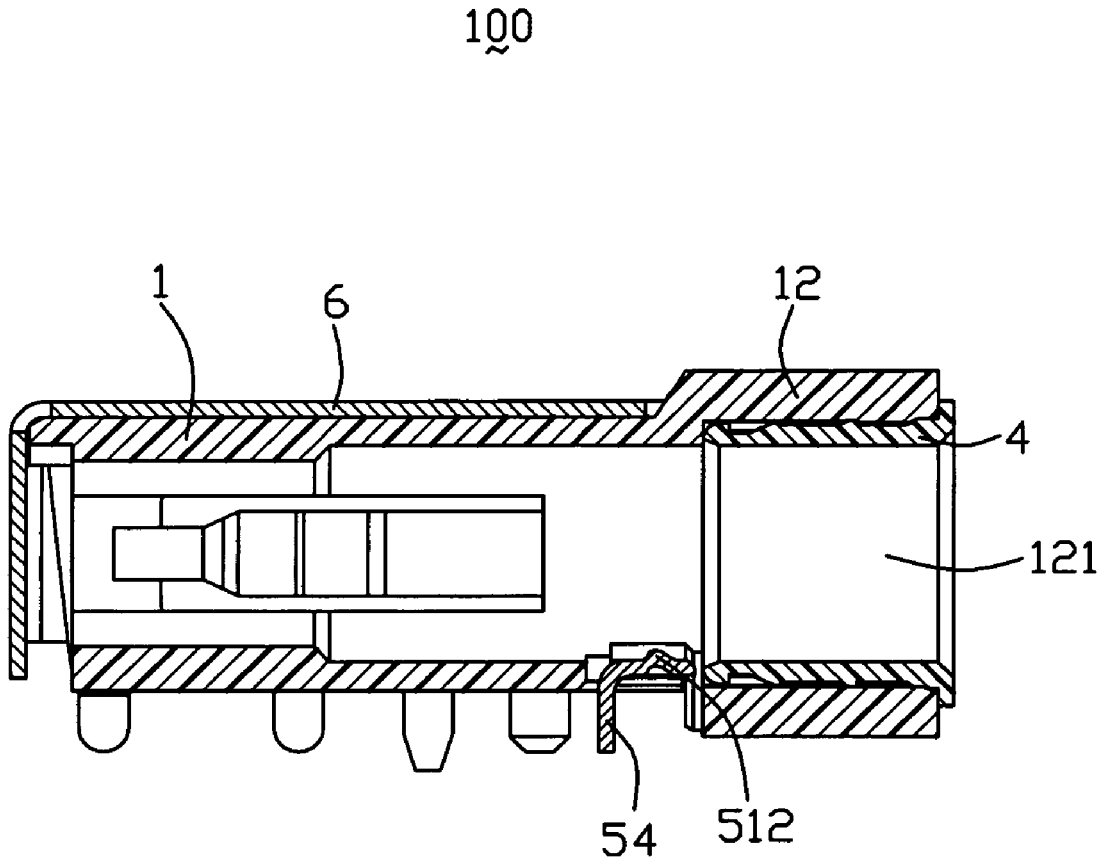
FIG. 6 is a cross-sectional view of the electrical connector taken along line 6-6 of FIG. 1.

Referring to FIG. 4, a receiving groove 113 near the mating portion 12 is defined at a bottom of the main body 11. The receiving groove 113 runs through the opposite two sidewalls of the main body 11 transversely and forms T-shape receiving slots 116 in the sidewalls. A through hole 115 connecting with the receiving cavity 121 is defined in the middle of the receiving groove 113. A pair of slots 114 is defined in an interface between the mating portion 12 and the main body 11, and aligned with the annular groove 412. Referring to FIG. 2, a symmetrical grounding contact 5, which is provided to retain the sleeve 4 in the mating portion 12, defines a base portion 51, a clip portion 52 with two clip legs extending vertically from one side of the base portion 51 and a grounding leg 54 extending from an opposite side of the base portion 51. The grounding leg 54 extends to an opposite direction to the clip leg. The middle portion of the base portion 51 is shaped in an arch portion 511, and the grounding leg 54 is extending from the arch portion 511, a projecting portion 512 is defined on the arch portion 511 and to contact the counter connector (as best shown in FIG. 6). The two clip legs are symmetrically positioned at two sides of the arch portion 511. Each clip leg provides with an arc inside edge, which corresponds with the annular groove 412. A T-shape retaining portion 53 corresponding the receiving slot 116, extends from each free end of the base portion 51.

Figure 5:
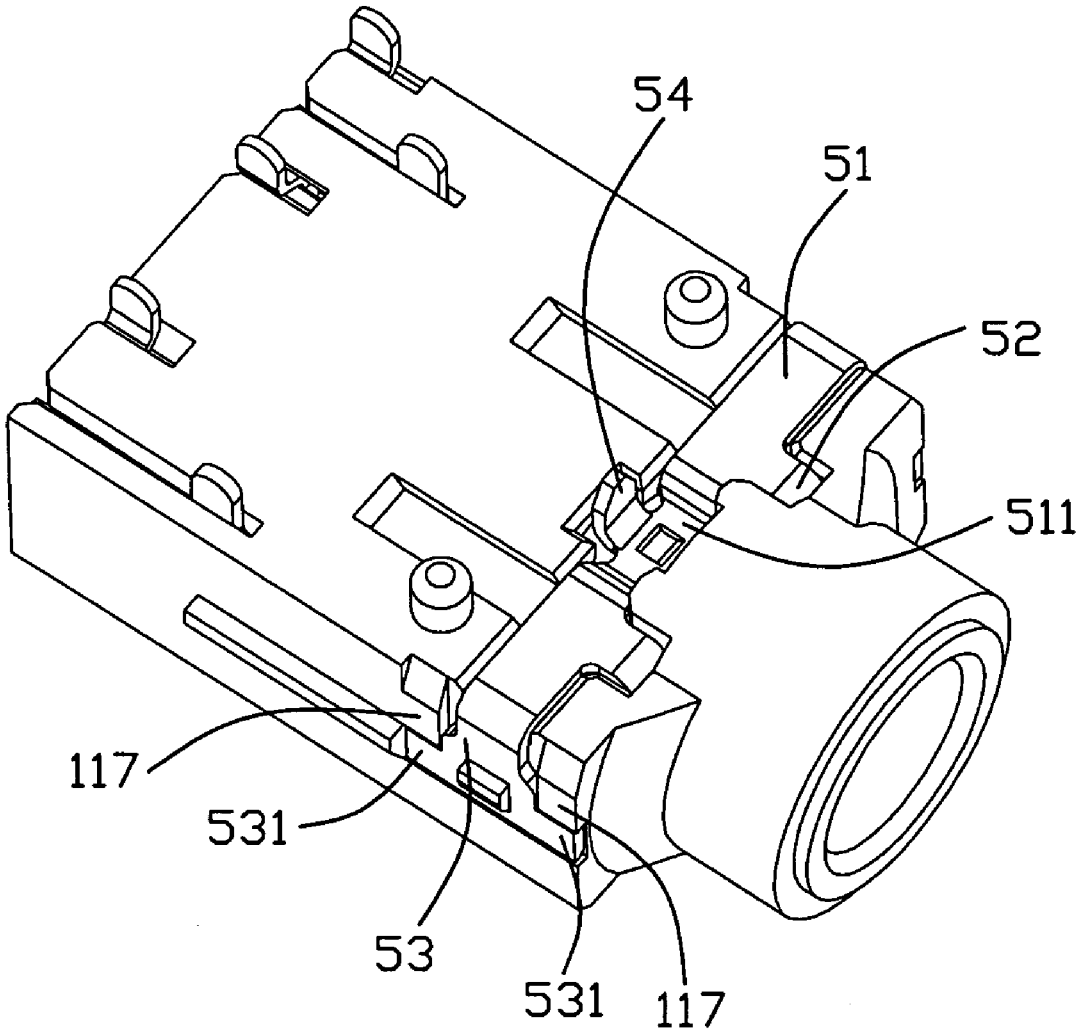
FIG. 5 is an assembly of the housing and the grounding contact of FIG. 4.
Figure 7:
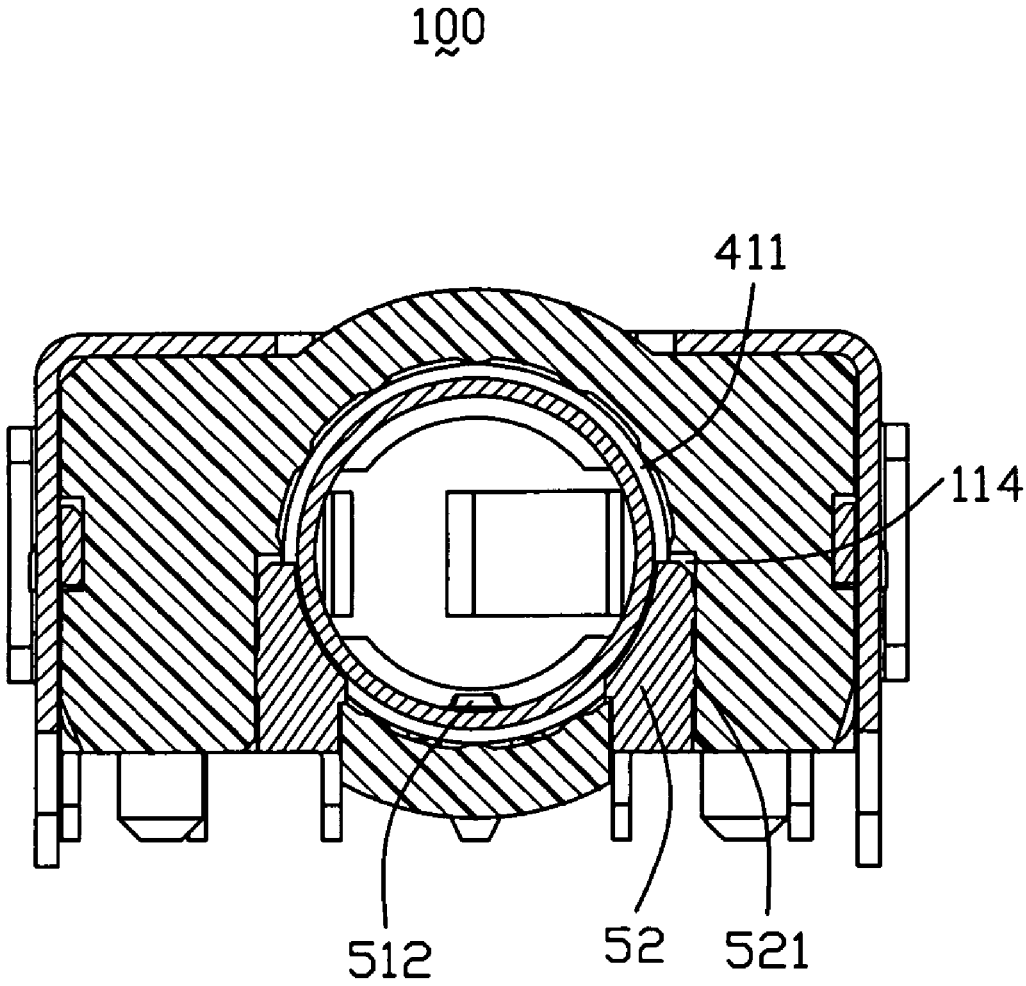
FIG. 7 is a cross-sectional view of the electrical connector taken along line 7-7 of FIG. 1.

Referring to FIGS. 4 and 5, the grounding contact 5 is retained in the receiving groove 113 with the retaining portions 53 received in the receiving slots 116. The retaining portion 53 defines a retaining block 531 at each end, and each retaining block 531 is blocked by protrusions 117 positioned beside the receiving slot 116 to retain the grounding contact 5 in the bottom of the housing 1 steadily. The arch 511 is received in the through hole 115, and the projecting portion 512 extends into the receiving cavity 121 to connect with the inserted counter connector. The clip legs of the clip portion 52 are foisted into the annular groove 412 through the slots 114 and blocked by the two protrusions 411, 413. At two sides of the clip portion 52, a plurality of tips 521 is provided to retain the grounding contact 5 in the housing (as best shown in FIG. 7). The grounding contact 5 fixes the sleeve 4 in the mating portion 12 smoothly, and prevents it from moving forwardly or backwardly.

Referring to FIGS. 1 and 2, the housing 1 is covered with the shielding shell 6. The rectangle shaped shield 3 comprises two side walls 61, a top wall 62 and a back wall 63. Two windows portion 611 are respectively defined at middle of the two side walls for cooperating with the protrusions 112 formed on the housing 1 to maintain the shied 3 on the housing 1. A pair of soldering legs 612 respectively extends downwardly from a bottom edge of the side wall 61. At the front end of each side wall 61, a hole 613 is defined thereof to receive a corresponding protrusion 532 defined in the retaining portion 53. A elastic portion 614 extends upwardly from an inside edge of the hole 613 and blocks the bottom of the protrusion 532 to prevent the shield 6 from moving off.

It is to be understood, however, that even though numerous characteristics and advantages of the present invention have been set forth in the foregoing description, together with details of the structure and function of-the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a receiving cavity therein;

at least one terminal arranged in the housing;

a sleeve retained in an inside of the receiving cavity; and a grounding contact defining a clip portion to lock the sleeve in the insulative housing;

wherein the clip portion extends from one side of the grounding contact to retain the sleeve in the insulative housing;

wherein the clip portion defines two clip legs corresponding a pair of slots defined in a bottom of the housing, and the two clip legs run through the pair of slots to retain the sleeve in the insulative housing;

wherein a groove is defined on the sleeve and the two clip legs foist into the groove to retain the sleeve in the insulative housing.

2. The electrical connecter as claimed in claim 1, wherein the sleeve is made from metal material.

3. The electrical connector as described in claim 1, wherein the groove is of an annular shape and defined along an outer perimeter surface of the sleeve.

4. The electrical connector as described in claim 1, wherein the clip portion is provided with tips at opposite lateral sides thereof to retain the clip portion in the slots.

5. The electrical connector as described in claim 1, wherein the grounding contact defines a base portion, an arch portion is defined in the middle portion of the base portion, a projecting portion is defined on the arch portion and runs into the receiving cavity.

6. The electrical connector as described in claim 1, wherein the grounding contact defines a base portion, a grounding leg extends from the base portion to an opposite direction to the clip portion.

7. The electrical connector as described in claim 1, wherein the grounding contact defines a base portion with two retaining portions thereof, each of the retaining portions extends from a free end of the base portion and is retained in a corresponding slot defined on a sidewall of the housing.

8. The electrical connecter as described in claim 1, wherein the grounding contact is assembled at the bottom of the housing.

9. An electrical connector comprising:

an insulative housing defining a front tubular section;

an sleeve defining a tubular main body with a front flange section, said tubular main body intimately radially contacting an inner face of said front tubular section, and said front flange section abutting, in an axial direction, against a front face of the tubular section;

a metallic piece attached to the housing in a direction perpendicular to said axial direction, and defines a locking device extending through the tubular section to engage said tubular main body for preventing forward movement of said sleeve from the tubular section;

wherein the locking device extends from one side of the metallic piece to retain the sleeve in the insulative housing;

wherein the locking device defines two clip legs corresponding a pair of slots defined in a bottom of the housing, and the two clip legs run through the pair of slots to retain the sleeve in the insulative housing;

wherein a groove is defined on the sleeve and the two clip legs foist into the groove to retain the sleeve in the insulative housing.

10. The electrical connector as claimed in claim 9, wherein said metallic piece is a grounding contact having a mounting leg for mounting to a printed circuit board.

11. The electrical connector as claimed in claim 9, wherein said metallic piece is upwardly assembled to an underside of the housing.

12. The electrical connector as claimed in claim 9, wherein said locking device defines two spaced parts sandwiching said sleeve therebetween in a balanced manner.

13. The electrical connector as claimed in claim 9, wherein said sleeve forms a recessed annular region to receive said locking device therein.

14. An electrical connector comprising:

an insulative housing defining a tubular mating section extending along an axial direction;

a sleeve having a tubular main body inserted into said tubular mating section and defining a recessed region around a rear end thereof; and a metallic piece assembled to the housing in a direction perpendicular to said axial direction; wherein said metallic piece includes a locking device extending through the tubular mating section and latchably received within said recessed region;

wherein the locking device extends from one side of the metallic piece to retain the sleeve in the insulative housing;

wherein the locking device defines two clip legs corresponding a pair of slots defined in a bottom of the housing, and the two clip legs run through the pair of slots to retain the sleeve in the insulative housing;

wherein a groove is defined on the sleeve and the two clip legs foist into the groove to retain the sleeve in the insulative housing.

15. The electrical connector as claimed in claim 14, wherein said locking device defines two spaced parts sandwiching said sleeve therebetween in a balanced manner.

* * * * *